US005645314A

United States Patent [19]

Liou

[11] Patent Number: 5,645,314

[45] Date of Patent: Jul. 8, 1997

[54] VENTILATION CUSHION FOR CHAIRS

[76] Inventor: Yaw-Tyng Liou, No. 116, Shih chien St., Fengyuan City, Taichung Hsien, Taiwan

[21] Appl. No.: 531,702

[22] Filed: Sep. 21, 1995

[51] Int. Cl.[6] ..... A47C 7/74

[52] U.S. Cl. ..... 297/180.14; 297/180.11; 297/452.46; 297/452.45; 5/423

[58] Field of Search ..... 297/180.1, 180.11, 297/180.13, 180.14, 452.45, 452.46; 5/421, 423, 468, 469

[56] References Cited

U.S. PATENT DOCUMENTS

| | | | |
|---|---|---|---|
| 2,684,672 | 7/1954 | Summerville | 297/180.1 X |
| 3,030,145 | 4/1962 | Kottemann | 297/180.11 |
| 3,681,797 | 8/1972 | Messner | 297/452.45 X |
| 3,940,183 | 2/1976 | Seltzer et al. | 297/452.45 |
| 4,413,657 | 11/1983 | Hayashi | 297/180.13 X |
| 5,004,294 | 4/1991 | Lin | 297/180.13 X |
| 5,106,161 | 4/1992 | Meiller | 297/452.46 |
| 5,403,065 | 4/1995 | Callerio | 297/180.14 X |

*Primary Examiner*—Peter R. Brown
*Attorney, Agent, or Firm*—Alfred Lei

[57] ABSTRACT

A ventilation cushion including a seat and a back cushion hinged together, each cushion defining a plurality of air passages and air holes, a plurality of air hoses connected between the seat cushion and the back cushion for guiding air between the cushions, and air fan means to draw air through the air holes and the air passages to ventilate the users back and bottom.

1 Claim, 4 Drawing Sheets

VENTILATION CUSHION FOR CHAIRS

BACKGROUND OF THE INVENTION

1. Field of the Invention

This invention relates to cushions for chairs, and relates more particularly to a ventilation cushion which ventilates the back and bottom of the user.

2. Description of the Prior Art

A variety of cushions have been developed for putting on a chair for a comfortable sitting. However, because regular cushions cannot ventilate the back and bottom of the user, when sitting on a cushion for a certain length of time, the user will still feel uncomfortable and shall have to change the position frequently. This problem occurs even when one sits in a cushion inside an air-conditioned room or car.

SUMMARY OF THE INVENTION

This invention is directed to a ventilation cushion which effectively ventilates the back and bottom of the user.

According to the preferred embodiment of the present invention, the ventilation cushion comprises a hinge, two base plates joined by the hinge, a seat cushion and a back cushion respectively mounted on the base plates, the seat cushion and the back cushion each comprising an upper half and a lower half, longitudinally and transversely aligned rows of flat blocks raised from the upper half, a plurality of longitudinally and transversely aligned air holes disposed in the spaces defined among the flat blocks, and a plurality of air passages in the lower half and in communication with the air holes respectively, a plurality of air hoses connected between the air passages in the seat cushion and the air passages in the back cushion, and two air fan means controlled to draw air through the back cushion and the seat cushion via the air holes and the air passages.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
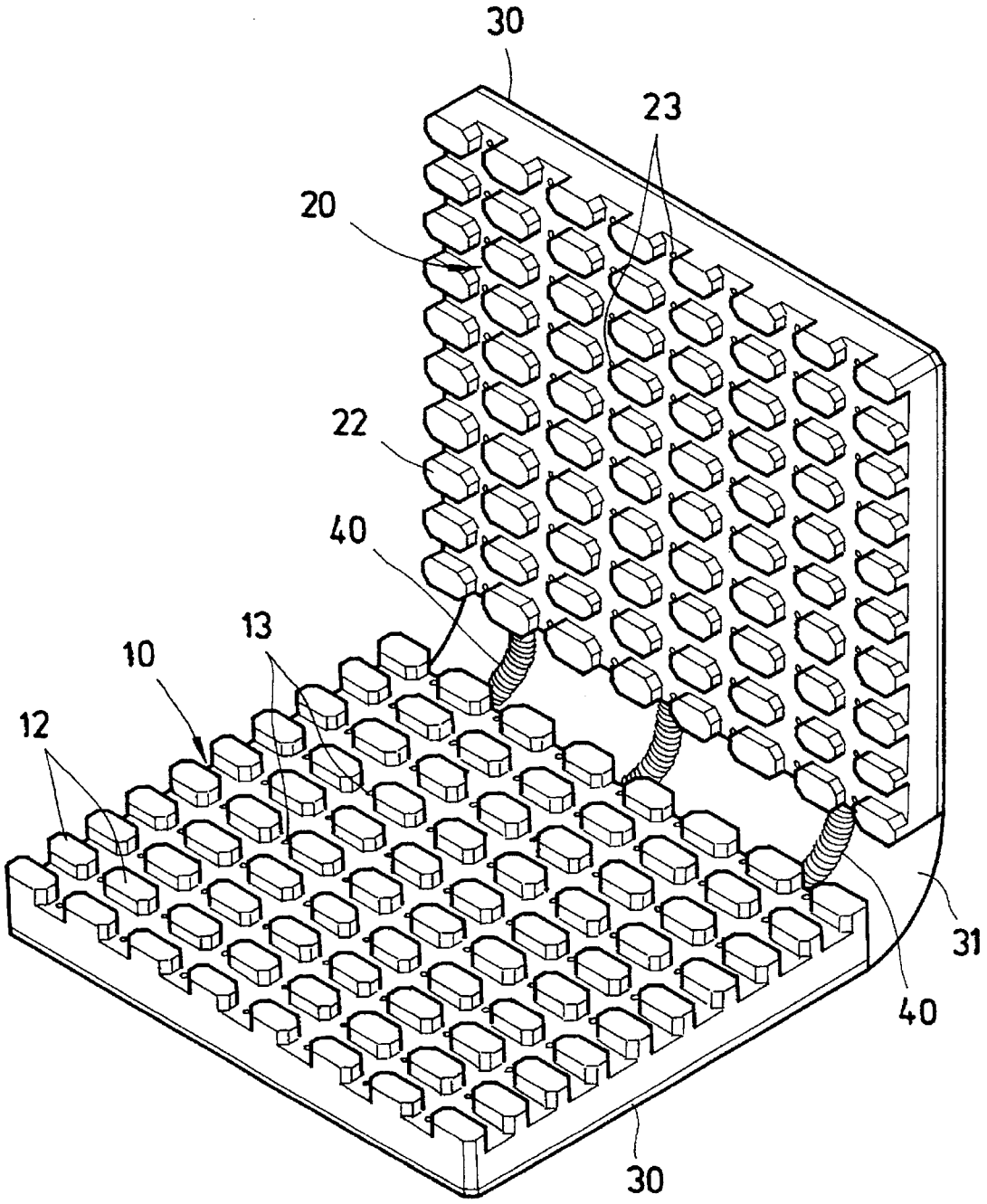
FIG. 1 an elevational view of a ventilation cushion according to the present invention.
Figure 2:
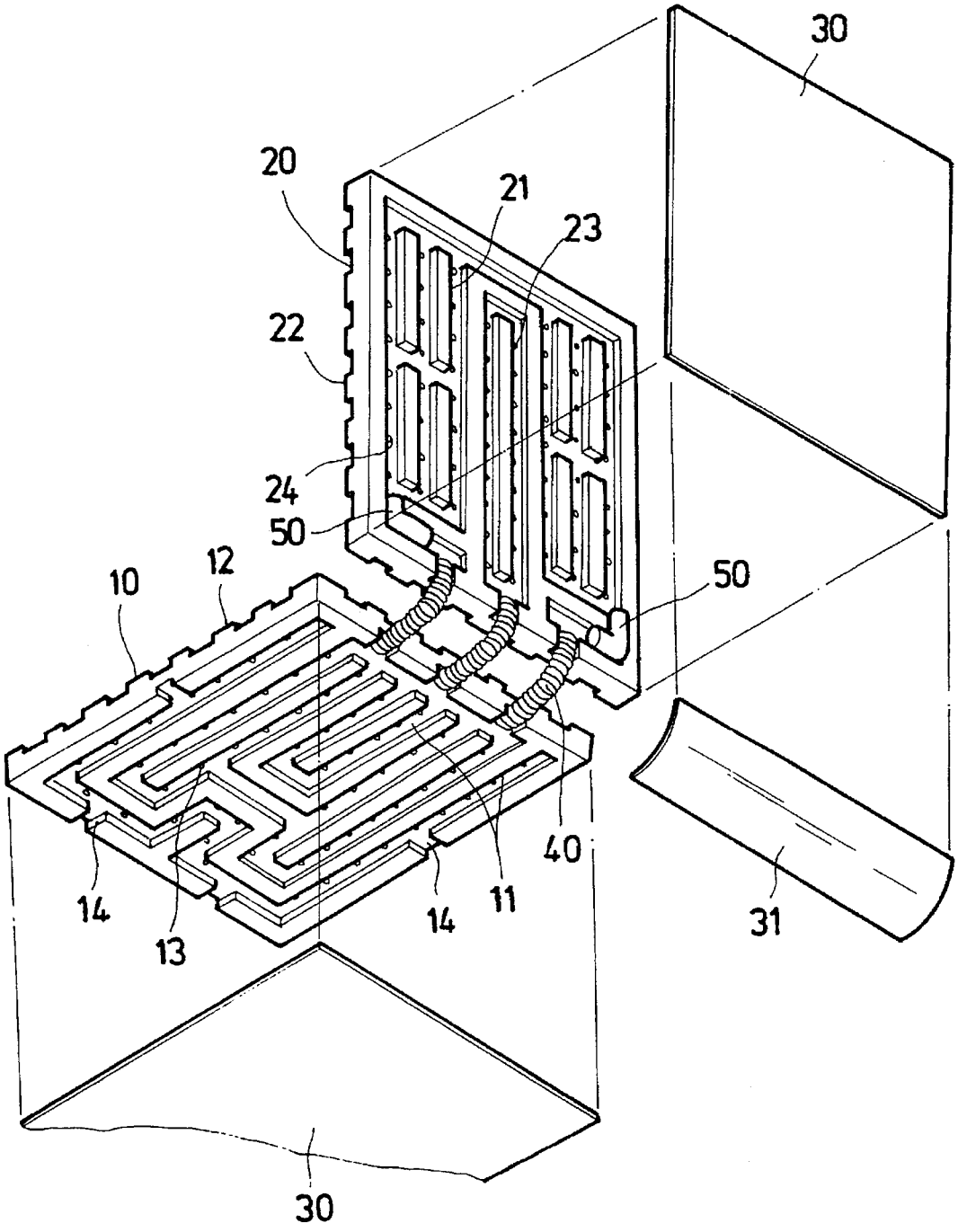
FIG. 2 is an exploded view of the ventilation cushion shown in FIG. 1.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIGS. 1, 2, 3, and 4, a ventilation cushion in accordance with the present invention is generally comprised of a seat cushion 10, a back cushion 20, a base plates 30, a hinge 31, a plurality of air hoses 40, and two air flowers 50. The seat cushion 10 and the back cushion 20 each has a soft upper half and a hard lower half. The soft upper half is preferably molded from polyurethane. The hard lower half is preferably molded from EVA (ethylene vinyl acetate). The base plates 30 are respectively covered on the seat cushion 10 and the back cushion 20 at the bottom, and joined by the hinge 31. The seat cushion 10 comprises longitudinally and transversely aligned rows of flat blocks 12 raised from the top side, a plurality of longitudinally and transversely aligned air outlet holes 13 disposed in the spaces defined among the flat blocks 12, and a plurality of air passages 11 in communication with the air outlet holes 13. The back cushion 20 comprises longitudinally and transversely aligned rows of flat blocks 22 raised from the top side, rows of air outlet holes 23 spaced between the flat blocks 22 in the middle, rows of air outlet holes 24 spaced between the flat blocks 22 at two opposite sides relative to the air outlet holes 23, and a plurality of air passages 21 respectively disposed in communication with the air outlet holes 23 and the air inlet holes 24. The air hoses 40 are connected between the air passages 21 of the back cushion 2 and the air passages 11 of the seat cushion 1. The air fan means 50 are bilaterally installed in the back cushion 20 near the seat cushion 10.

Figure 3:
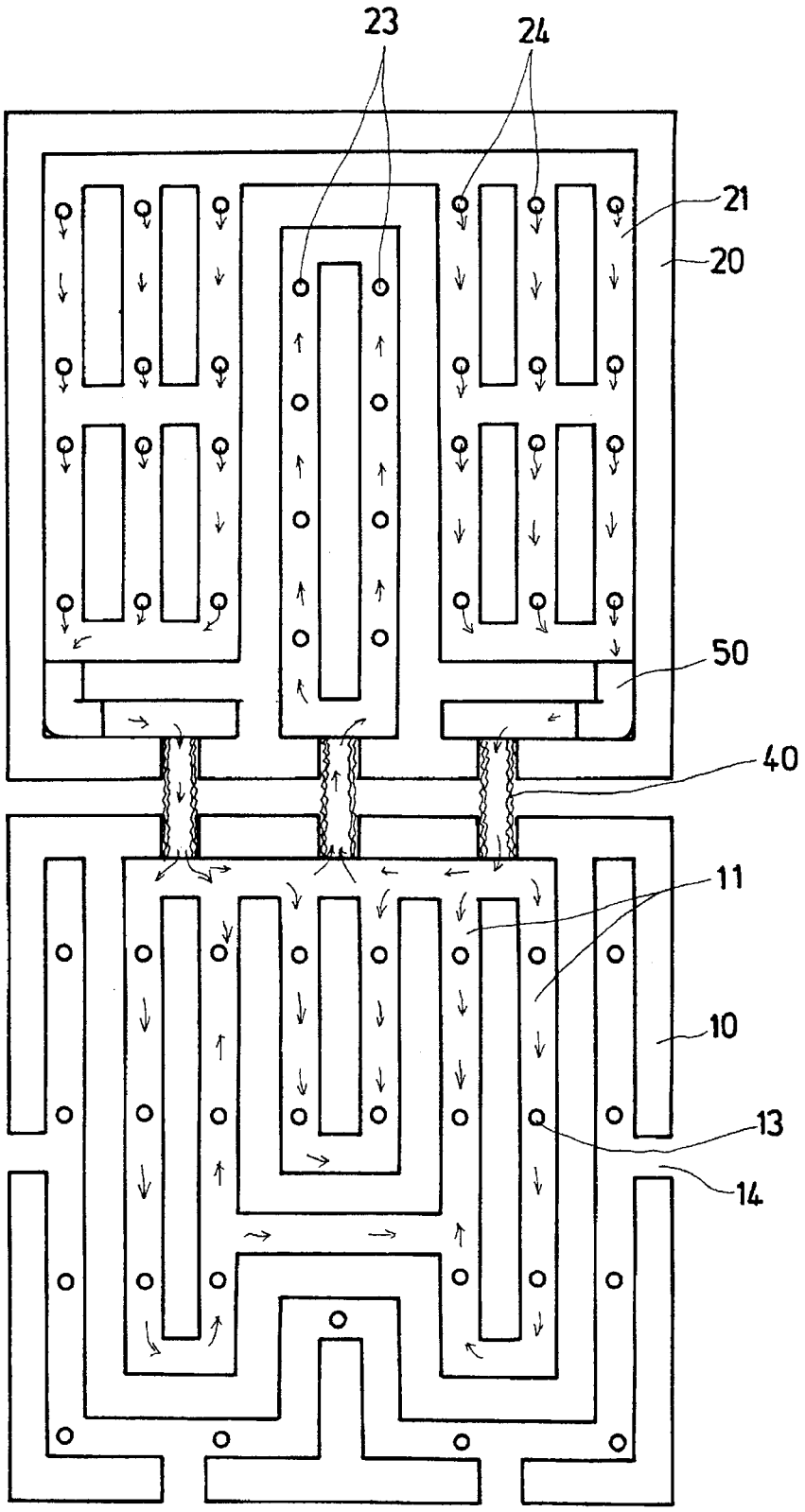
FIG. 3 shows the arrangement of the air passages and vent holes in the ventilation cushion according to the present invention.

Referring to FIGS. 2 and 3 again, the air passages 21 of the back cushion 20 are divided into two groups, namely, the intermediate air passages and the lateral air passages. The lateral air passages are disposed in communication with the air inlet holes 24 and connected to the air passages 11 of the seat cushion 10 by air hoses 40. The intermediate air passages are disposed in communication with the air outlet holes 23 and connected to the air passages 11 of the seat cushion 10 by one air hose 40. The air fan means 50 are bilaterally installed in the back cushion 20 adjacent to the seat cushion 10. The air input port of each air fan means 50 is connected to the lateral air passages of the back cushion 20. The air output port of each air fan means 50 is connected to one air hose 40. Therefore, when the air fan means 50 are operated, outside air is drawn into the air inlet holes 24 and then driven into the air passages 11 of the seat cushion 10. The air passages 11 are distributed through the whole area of the seat cushion 10 and communicating with one another. The air passages 11 of the seat cushion 10, except the air passage around the border, form an air circulation loop. The air passage around the border is for guiding air out of the seat cushion 10 sideways through side holes 14. As shown in FIG. 3, the air passages 11 of the seat cushion 10 communicates with one another and connected to the air fan means 50 by the two air hoses 40 at two opposite sides. This design of seat cushion 10 effectively guides cool air to the user's seat and thighs. The intermediate air hose 30 guides cool air to the back cushion 20, permitting it to escape out of the back cushion 20 through the air outlet holes 24 and to further ventilate the back of the user.

Figure 4:
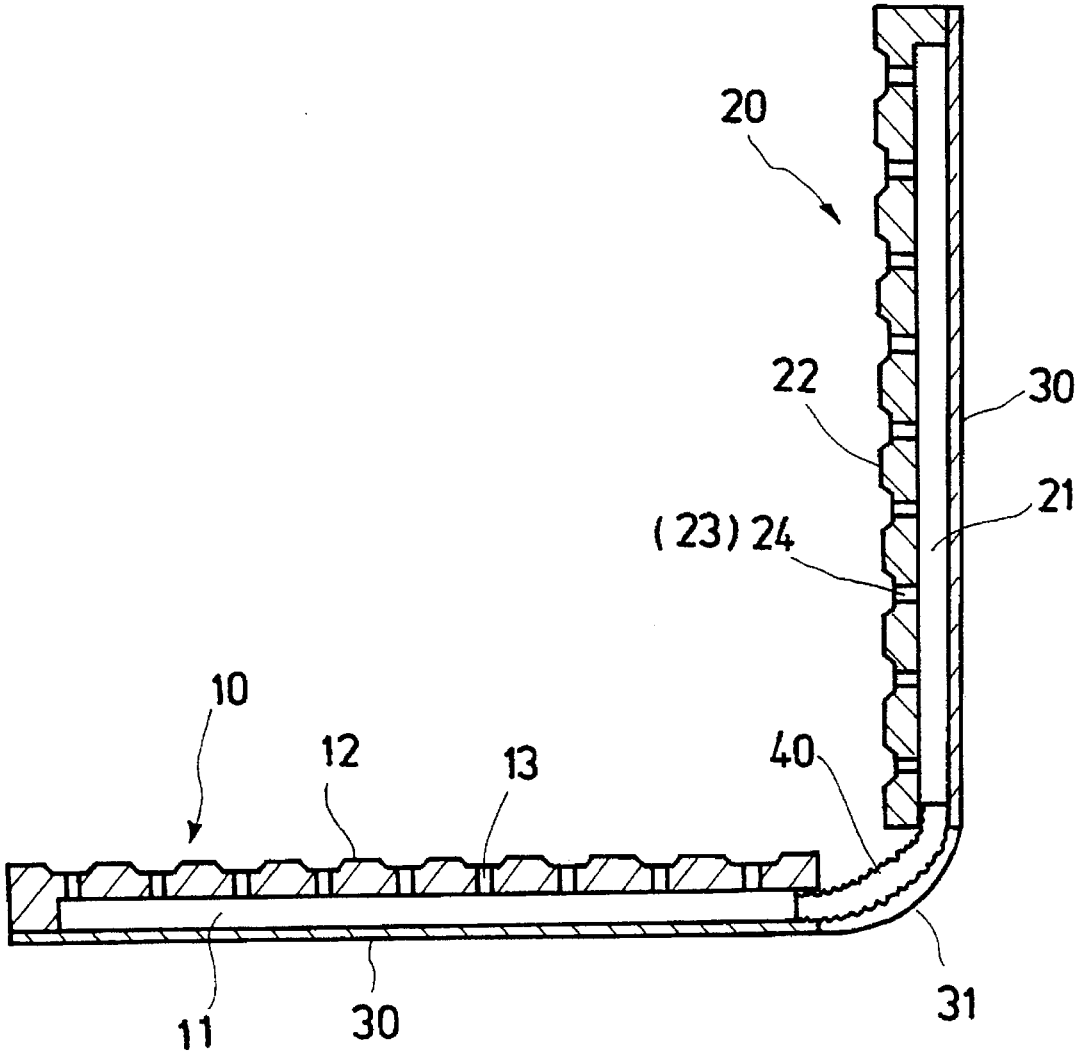
FIG. 4 is a side view in section of FIG. 1.

Referring to FIG. 4, because the upper halves of the seat cushion 10 and the back cushion 20 are soft, the user feels comfortable when sits on. However, because the lower halves of the seat cushion 10 and the back cushion 20 are relatively harder, they are not deformed when the user sits on the ventilation cushion, and therefore the air passages 11 and 21 are constantly maintained effective (the air passages 11 and 21 are made within the hard lower halves.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A ventilation cushion comprising a hinge, two base plates joined by said hinge, a seat cushion and a back cushion respectively mounted on said base plates, said seat cushion and said back cushion each comprising an upper portion and a lower portion, longitudinally and transversely aligned rows of flat blocks raised from said upper portion, a plurality of longitudinally and transversely aligned air holes disposed in the spaces defined among said flat blocks, and a plurality of air passages in said lower portion and in communication with said air holes respectively, and a plurality of air hoses connected between the air passages in said seat cushion and the air passages in said back cushion, the air passages of said seat cushion including a plurality of inner air passages forming an air circulation loop and an outer air passage surrounding said air circulation loop, said outer air passage having a plurality of side holes for guiding air sideways out of said seat cushion, the air passages of said back cushion includes two opposite lateral air passages and a plurality of intermediate air passages between said lateral air passages, said lateral inner air passages being connected to the air passages of said seat cushion by a respective one of said air hoses for guiding air to said inner air passages of said seat cushion, said intermediate air passages being connected to said seat cushion by one of said air hoses for receiving air from said seat cushion, the air holes of said seat cushion being air outlet holes for guiding air out of said seat cushion, the air holes of said back cushion including a plurality of air inlet holes respectively disposed in communication with two opposite lateral air passages on said back cushion, a plurality of air outlet holes respectively disposed said intermediate air passages of the back cushion, and two air fan means bilaterally installed in said back cushion adjacent to said seat cushion and controlled to draw air through said back cushion and said seat cushion via said air holes and said air passages, the upper portions of said seat cushion and said back cushion being made of soft materials, and the lower portions thereof being made of harder materials than that of said upper portions, said seat cushion and said back cushion being respectively molded in integrity.

* * * * *